United States Patent [19]

Isobe

[11] Patent Number: 4,487,190

[45] Date of Patent: Dec. 11, 1984

[54] ELECTRONIC FUEL INJECTING METHOD AND DEVICE FOR INTERNAL COMBUSTION ENGINE

[75] Inventor: Toshiaki Isobe, Nagoya, Japan

[73] Assignee: Toyota Jidosha Kogyo Kabushiki Kaisha, Toyota, Japan

[21] Appl. No.: 391,433

[22] Filed: Jun. 23, 1982

[30] Foreign Application Priority Data

Feb. 25, 1982 [JP] Japan ..... 57-29484

[51] Int. Cl.[3] ..... F02D 5/00

[52] U.S. Cl. ..... 123/492; 123/493

[58] Field of Search ..... 123/492, 493, 480, 486

[56] References Cited

U.S. PATENT DOCUMENTS

| | | | |
|---|---|---|---|
| 3,926,153 | 12/1975 | Reddy | 123/492 |
| 4,184,458 | 1/1980 | Aoki et al. | 123/480 |
| 4,356,803 | 11/1982 | Miyagi | 123/492 |
| 4,359,993 | 11/1982 | Carlson | 123/492 |

*Primary Examiner*—Andrew M. Dolinar

*Attorney, Agent, or Firm*—Cushman, Darby & Cushman

[57] ABSTRACT

Electronic fuel injecting method and device for an internal combustion engine, wherein a basic injection time is obtained in accordance with an intake pressure of the engine and an engine rotational speed. During transitions, the basic injection time is corrected in accordance with the operating conditions of the engine so as to determine a fuel injection time. A throttle valve opening correction is increased or decreased in accordance with a changing speed of the throttle valve opening, and subsequently, is attenuated at a predetermined attenuation rate or restored at a predetermined restoration rate. An intake pressure is increased or decreased in accordance with a changing speed of the intake pressure, and subsequently, is attenuated at a predetermined attenuation rate or restored at a predetermined restoration rate. These corrections are combined to obtain a correction value for acceleration and deceleration, and the correction value is used to modify the basic injection time. The attenuation rate or the restoration rate of the throttle valve opening correction is made higher than the attenuation rate or the restoration rate of the intake pressure correction.

9 Claims, 5 Drawing Figures

ELECTRONIC FUEL INJECTING METHOD AND DEVICE FOR INTERNAL COMBUSTION ENGINE

BACKGROUND OF THE INVENTION

1. Field of the Invention

This invention relates to an electronic fuel injecting method and device for an internal combustion engine, and more particularly to improvements in an electronic fuel injecting method and device suitable for use in an internal combustion engine for a motor vehicle having a D-J type electronic fuel injection system, wherein a basic injection time is obtained in accordance with an intake pressure of the engine and an engine rotational speed, and, during transition, the basic injection time is corrected in accordance with the operating conditions of the engine so as to determine a fuel injection time.

2. Description of the Prior Art

The methods of supplying a mixture of a predetermined air-fuel ratio to combustion chambers of an internal combustion engine for a motor vehicle and the like include one using an electronic fuel injection system. According to this method, either a plurality of injectors, as many as the number of cylinders of the engine, or a single injector for the injection of fuel into the engine are provided, for example, on an intake manifold or a throttle body of the engine. The valve-opening time period of the injectors or injector is controlled in accordance with the operating conditions of the engine, so that a mixture of a predetermined air-fuel ratio can be supplied to the combustion chambers of the engine. This electronic fuel injection system is broadly divided into two systems including a so-called L-J type electronic fuel injection system wherein a basic injection time is obtained in accordance with an intake air flow rate of the engine and an engine rotational speed and a so-called D-J type electronic fuel injection system wherein a basic injection time is obtained in accordance with an intake pressure of the engine and an engine rotational speed.

The former can control the air-fuel ratio with high accuracy and is commonly used for the engines of motor vehicles to which is applied an exhaust gas purification system. However, in this L-J type electronic fuel injection system, the dynamic range of the intake air flow rate is so wide that the intake air flow rate at the time of high load is increased to about 50 times that at the time of idling, thereby presenting the following disadvantages. Namely, not only the accuracy is decreased when the intake air flow rate is converted into a digital signal, but also a bit length of the digital signal is lengthened when it is desired to improve the counting accuracy in a digital control circuit at the latter stage, whereby an expensive computer is required for the digital control circuit. Moreover, a measuring instrument having a construction with high accuracy such as an air flow meter or the like is required to measure the intake air flow rate, to thereby increase the installation cost.

On the other hand, the latter D-J type electronic fuel injection system has the features that the dynamic range of the intake pressure is so narrow that the variation value of the intake pressure is as low as two to three times. Not only is the operation in the digital control circuit at the latter stage facilitated, but also a pressure sensor for detecting the intake pressure is inexpensive. However, as compared with the L-J type electronic fuel injection system, the D-J type electronic fuel injection system has a low control accuracy of the air-fuel ratio, and particularly, has a low quality performance during acceleration because the fuel injection time is not increased until the intake pressure increases which lags the acceleration command so that the air-fuel ratio becomes lean temporarily. To obviate the disadvantages as described above, heretofore, an increased correction for acceleration has been provided in response to a pulse train fed from a comb-shaped sensor provided on a throttle valve. However, in order to improve the driverability, it is necessary to increase the increase correction to a considerable extent. In that case, the air-fuel ratio has become over-rich, and the value of carbon monoxide contained in the exhaust gas has increased to an unusually high extent, so that the air-fuel ratio could not be maintained within a predetermined range suitable for a three-way catalytic converter. This is also true where the fuel injection time is feedback controlled in response to an oxygen concentration sensor provided at the downstream side of the exhaust gas, because the oxygen concentration sensor is slow in response. In consequence, heretofore, it has been thought difficult to use the D-J type electronic fuel injection system in the engine for the motor vehicle, to which an exhaust gas purification system is applied, requiring air-fuel ratio control with high accuracy.

Furthermore, in the D-J type electronic fuel injection system, the fuel injection time is not decreased during deceleration unless the intake pressure decreases, whereby the air-fuel ratio becomes rich temporarily, thus degrading exhaust gas purification performance.

SUMMARY OF THE INVENTION

The present invention has been developed to obviate the above-described disadvantages of the prior art and has as its first object the provision of an electronic fuel injecting method for an internal combustion engine, capable of effecting suitable increase or decrease correction during acceleration or deceleration so as to maintain an air-fuel ratio in the vicinity of the stoichiometric air-fuel ratio, and consequently, capable of making a satisfactory acceleration-deceleration performance compatible with an exhaust gas purification performance.

The present invention has as its second object the provision of an electronic fuel injecting method of an internal combustion engine, capable of effecting suitable increase correction during acceleration so as to maintain an air-fuel ratio in the vicinity of the stoichiometric air-fuel ratio, and consequently, capable of making a satisfactory acceleration performance compatible with an exhaust gas purification performance.

The present invention has as its third object the provision of an electronic fuel injecting method of an internal combustion engine, capable of effecting suitable decrease correction during deceleration so as to maintain an air-fuel ratio in the vicinity of the stoichiometric air-fuel ratio, and consequently, capable of making a satisfactory deceleration performance compatible with an exhaust gas purification performance.

The present invention has as its fourth object the provision of an electronic fuel injection device of an internal combustion engine, wherein the above-described objects are achieved.

To achieve the first object, the present invention contemplates that, in an electronic fuel injecting method for an internal combustion engine, wherein a basic injection time is obtained in accordance with an intake pressure of the engine and an engine rotational speed, during transitions, the basic injection time is corrected in accordance with the operating conditions of the engine so as to determine a fuel injection time. A throttle valve opening correction is increased or decreased in accordance with the changing speed of the throttle valve opening. An intake pressure correction is increased or decreased in accordance with the changing speed of the intake pressure. These corrections are combined to obtain a correction value for acceleration or deceleration, and then used to alter the basic injection time. After the corrections are changed, they are attenuated at predetermined rates. In the present invention, the attenuation rate of the throttle valve opening correction is made higher than the attenuation rate of the intake pressure correction.

To achieve the second object, the present invention contemplates that, in an electronic fuel injecting method for an internal combustion engine as described above, an after-idle correction is increased when an idle switch is turned "OFF". Subsequently, the after-idle correction is attenuated at a predetermined attenuation rate. A throttle valve opening correction is increased in accordance with the increasing speed of the throttle valve opening. Subsequently, the valve opening correction is attenuated at a predetermined attenuation rate. An intake pressure correction is increased in accordance with the increasing speed of the intake pressure. Subsequently, the intake pressure is attenuated at a predetermined attenuation rate. These corrections are combined to obtain an correction value for acceleration which is employed to alter the basic injection time. In the present invention, the attenuation rates of the after-idle correction and of the throttle valve opening correction are made higher than the attenuation rate of the intake pressure correction.

To achieve the third object, the present invention contemplates that, in an electronic fuel injecting method for an internal combustion engine as described above, a throttle valve opening correction is decreased in accordance with the decreasing speed of the throttle valve opening. Subsequently, it is restored at a predetermined restoration rate. An intake pressure correction is decreased in accordance with the decreasing speed of the intake pressure, and is subsequently restored at a predetermined restoration rate. These corrections are combined to obtain a correction value for deceleration which is employed to alter the basic injection time. In the present invention, the restoration rate of the throttle valve opening correction is made higher than the restoration rate of the intake pressure decrease correction.

To achieve the fourth object, the present invention contemplates an electronic fuel injection device for an internal combustion engine. An intake air temperature sensor detects the temperature of intake air taken in by an air cleaner. A throttle sensor includes an idle switch for detecting whether a throttle valve is in an idle opening or not and a potentiometer for generating a voltage output proportional to the opening of the throttle valve. An intake pressure sensor detects an intake pressure through a pressure in a surge tank. An injector provides fuel to the engine. A crank angle sensor outputs a crank angle signal in accordance with a rotation of the engine. A coolant temperature sensor detects the temperature of engine coolant. A digital control circuit determines a basic injection time in accordance with an intake pressure fed from the intake pressure sensor and an engine rotational speed obtained from an output from the crank angle sensor. The basic injection time thus obtained is corrected in accordance with an output from the throttle sensor and the temperature of engine coolant fed from the coolant temperature sensor and the like to determine a fuel injection time and output an injector opening time signal to the injector. The control circuit also adjusts a number of corrections. An after-idle correction is increased when an idle switch is turned "OFF", and subsequently, is attenuated at a predetermined attenuation rate. A throttle valve opening correction is increased or decreased in accordance with the changing speed of the throttle valve opening obtained from an output of the potentiometer of the throttle sensor, and subsequently, is attenuated at a predetermined attenuation rate or restored at a predetermined restoration rate. An intake pressure correction is increased or decreased in accordance with the changing speed of the intake pressure detected from an output of the intake pressure sensor, and subsequently, is attenuated at a predetermined attenuation rate or restored at a predetermined restoration rate. These corrections are combined to obtain an correction value for acceleration or deceleration which is employed to alter the basic injection time. In the present invention, the attenuation rates or the restoration rate of the after-idle increase correction and the throttle valve opening increase or decrease correction are made higher than the attenuation rate of the restoration rate of the intake pressure increase or decrease correction.

According to the present invention, a suitable correction for acceleretion or deceleration is obtainable, and the air-fuel ratio is maintained in the vicinity of the stoichiometric air-fuel ratio, so that a satisfactory acceleration and deceleration performance can be made compatible with the exhaust gas purification performance. In consequence, even when D-J type electronic fuel injection system is used, an accurate air-fuel ratio control can be carried out.

DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiments of the present invention with reference to the drawings.

Figure 1:
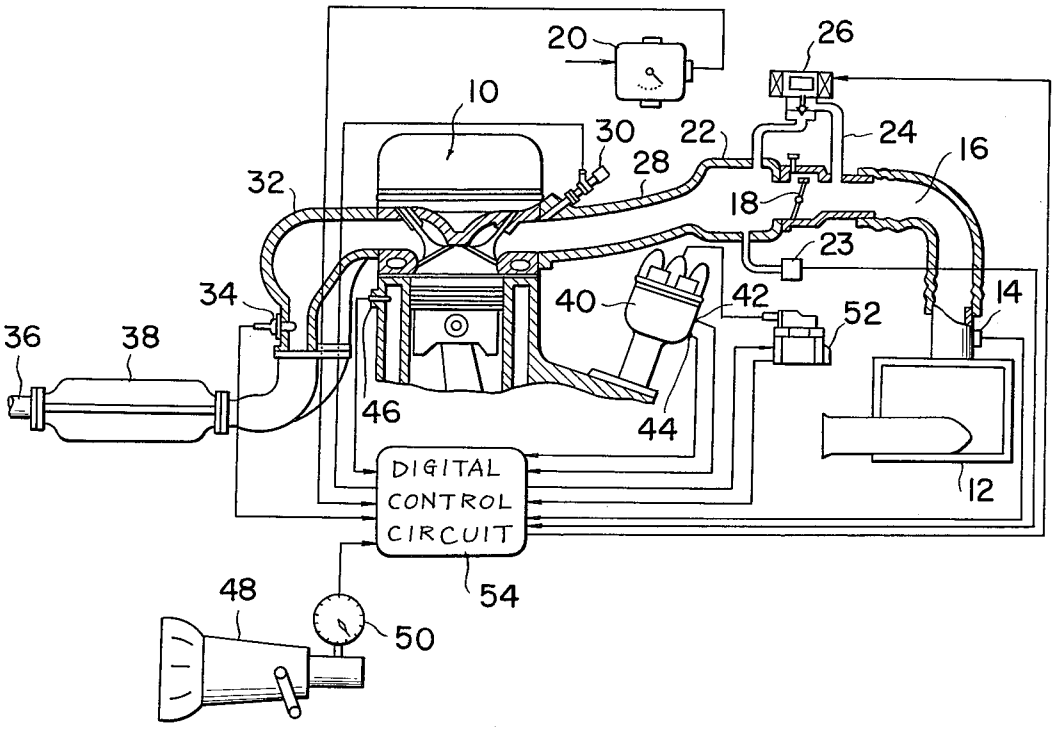
FIG. 1 is a block diagram showing an embodiment of a D-J type electronic fuel injection device of an engine for a motor vehicle, in which is adopted the electronic fuel injecting method for the internal combustion engine according to the present invention.
Figure 2:
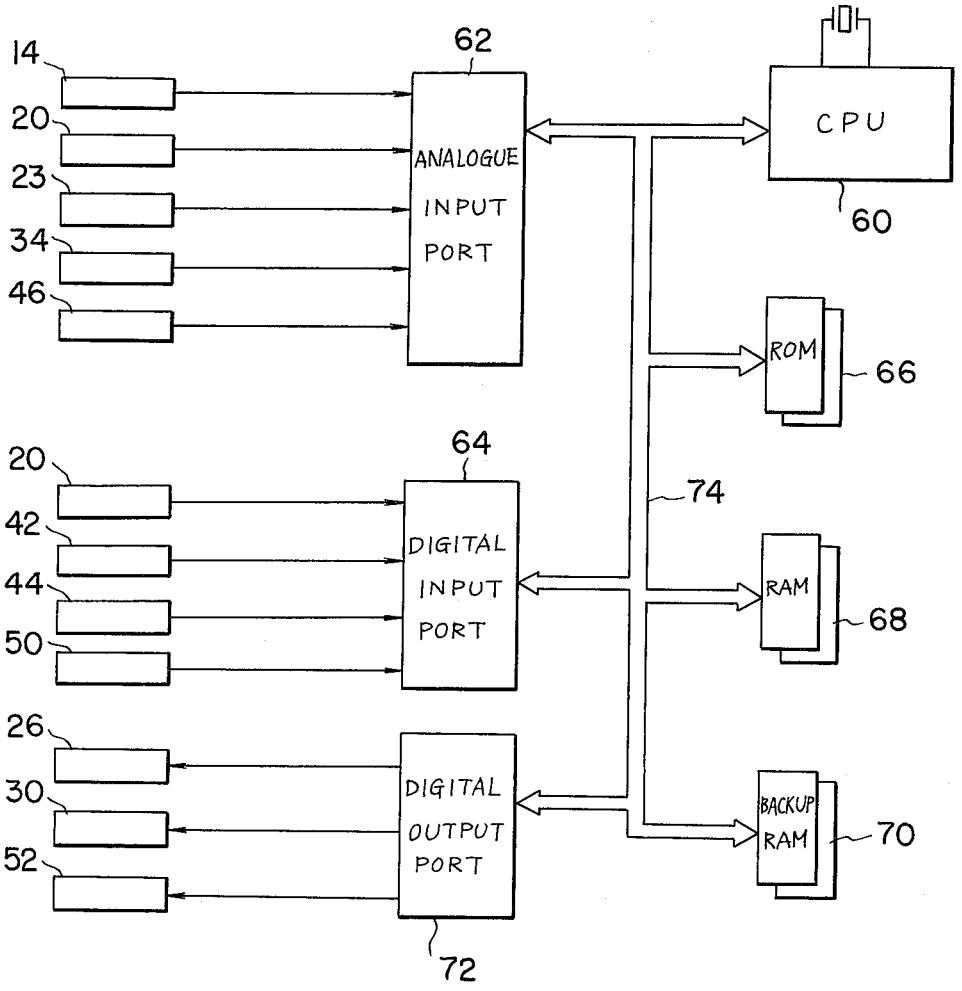
FIG. 2 is a block diagram showing the arrangement of the digital control circuit used in the above-mentioned embodiment.

As shown in FIGS. 1 and 2, one embodiment of the D-J type electronic fuel injection device of an engine 10 of a motor vehicle adopting the electronic fuel injecting method for an internal combustion engine according to the present invention, comprising:

an air cleaner 12 for taking in atmosphere;

an intake air temperature sensor 14 for detecting the temperature of intake air taken in through the aircleaner 12;

a throttle valve 18 provided in an intake air passage 16 and adapted to be interlocked with an accelerator pedal, not shown, provided around a driver's seat to be opened or closed, for controlling the flow rate of intake air;

a throttle sensor 20 including an idle switch for detecting whether the throttle valve 18 is in an idel opening or not and a potentiometer for generating a voltage output proportional to the opening of the throttle valve 18;

a surge tank 22;

an intake pressure sensor 23 for detecting the intake pressure from a pressure in the surge tank 22;

a bypass passage 24 for bypassing the throttle valve 18;

an idle speed control valve 26 provided at the intermediate portion of the bypass passage 24 for controlling the opening area of the bypass passage 24 to control an idle rotational speed;

an injector 30 for blowing fuel out into an intake port of the engine 10;

an oxygen concentration sensor 34 provided on an exhaust manifold 32 for detecting an air-fuel ratio from the residual oxygen concentration in the exhaust gas;

a three-way catalytic converter 38 provided at the intermediate portion of an exhaust pipe 36 at the downstream side of the exhaust manifold 32;

a distributor 40 having a distributor shaft rotatable in operational association with a crankshaft of the engine 10;

a top dead center sensor 42 and a crank angle sensor 44 incorporated in the distributor 40 for outputting a top dead center signal and a crank angle signal in accordance with the rotation of the distributor shaft, respectively;

a coolant temperature sensor 46 provided on an engine block for detecting the temperature of engine coolant;

a vehicle speed sensor 50 for detecting a running speed of the vehicle from the rotational speed of an output shaft of a transmission 48; and a digital control circuit 54, in which a basic injection time per cycle of the engine is obtained from a map in accordance with the intake pressure fed from the intake pressure sensor 23 and the engine rotational speed obtained from an output of the crank angle sensor 44, the basic injection time thus obtained is corrected in accordance with an output from the throttle sensor 20, an air-fuel ratio fed from the oxygen concentration sensor 34, the temperature of engine coolant fed from the coolant temperature sensor 46 and the like to determine a fuel injection time, whereby an injector opening time signal is fed to the injector 30, an ignition timing is determined in accordance with the operating condition of the engine to feed an igniting signal to a coil 52 provided thereon with an igniter, and further, the idle speed control valve 26 is controlled during idling. In the digital control circuit 54, an after-idle correction is increased when the idle switch of the throttle sensor 20 is turned "OFF", and subsequently, is attenuated at a predetermined attenuation rate. A throttle valve opening correction is increased or decreased in accordance with the changing speed of the throttle valve opening obtained from an output from the potentiometer of the throttle sensor 20, and subsequently, is attenuated at a predetermined attenuation rate. An intake pressure correction is increased or decreased in accordance with the changing speed of the intake pressure detected from an output from the intake pressure sensor 23, and subsequently, is attenuated at a predetermined attenuation rate. These corrections are combined to obtain a correction value for acceleration or deceleration which is used to change the basic injection time. Also, the attenuation rates of the after-idle correction and the throttle valve opening correction are made higher than the attenuation rate of the intake pressure correction.

As detailedly shown in FIG. 2, the digital control circuit 54 comprises:

a Central Processing Unit 60 (hereinafter referred to as "CPU") consisting of a microcomputer for performing various operations; an analogue input port 62 provided thereon with a multiplexer for converting analogue signals fed from the intake air temperature sensor 14, the potentiometer of the throttle sensor 20, the intake pressure sensor 23, the oxygen concentration sensor 34, the coolant temperature sensor 46 and the like into digital signals and successively taking into CPU 60; a digital input port 64 for taking into CPU 60 with predetermined timings digital signals fed from the idle switch of the throttle sensor 20, the top dead center sensor 42, the crank angle sensor 44, the vehicle speed sensor 50 and the like; a Read Only Memory 66 (hereinafter referred to as "ROM") for storing programs, various constants or the like; a Random Access Memory 68 (hereinafter referred to as "RAM") for temporarily storing operation data in CPU 60 and the like; a backup Random Access Memory 70 for being supplied thereto with current from an auxiliary power source, when the engine is stopped, to hold memory; a digital output port 72 for outputting the result of operation in CPU 60 with predetermined timings to the idle speed control valve 26, the injector 30, the coil 52 with the igniter and the like; and a common bus 74 for interconnecting the above-described components to one another.

Description will hereunder be given of the operation of the preferred embodiment.

Firstly, the digital control circuit 54 reads out the basic injection time period TP(PM, NE) from the intake pressure PM fed from the intake pressure sensor 23 and the engine rotational speed calculated from an output of the crank angle sensor 44, through a map previously stored in ROM 66.

Subsequently, the basic injection time period TP (PM, NE) is corrected through the following equation in response to signals from the respective sensors so as to calculate a fuel injection time period TAU.

$$TAU = TP(PM, NE) \times (1 + K \times F) \quad (1)$$

where F is a coefficient of correction, and F indicates a correction value which may be positive or negative in value. Additionally, K is a multiplying factor of correction for a further correction, and is normally represented by 1.

A fuel injection time signal corresponding to the fuel injection time period TAU thus determined is fed to the injector 30, whereby the injector 30 is opened only for the fuel injection time period TAU in synchronism with the engine rotation, so that fuel can be blown out into the intake manifold 28 of the engine 10.

The correction for acceleration or deceleration in this embodiment is obtained in the following manner.

Figure 3:
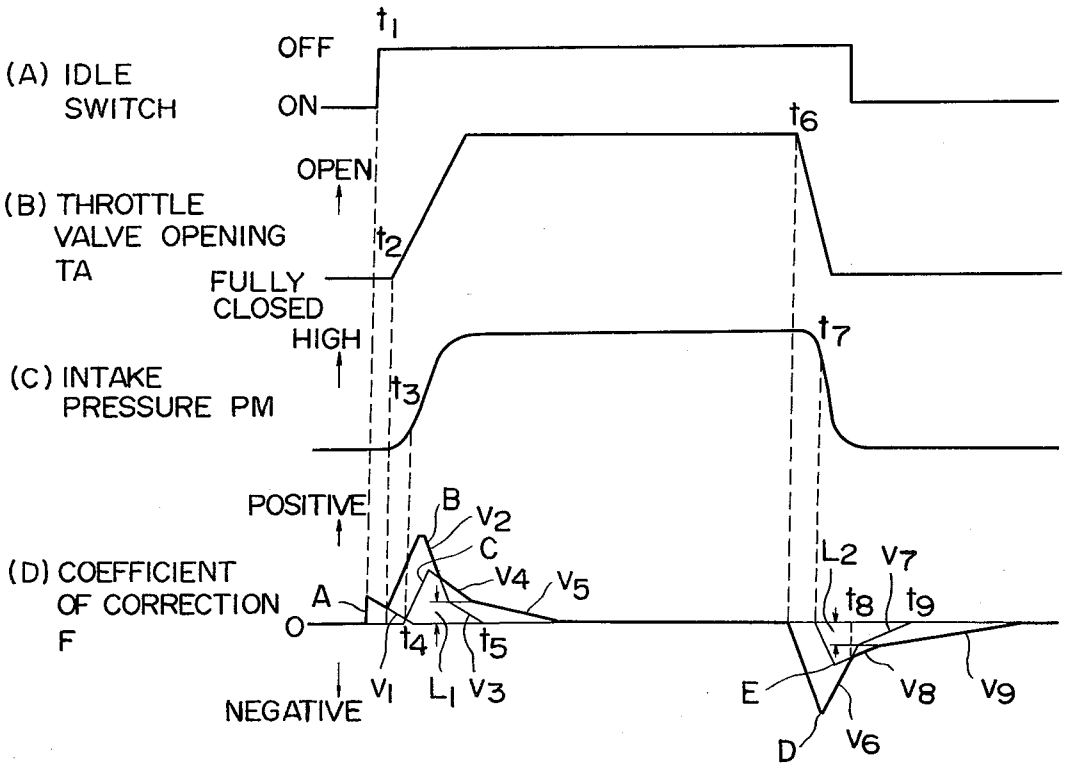
FIG. 3 is a graphic chart showing the conditions of the increase correction for acceleration and the decrease correction for deceleration in the above-mentioned embodiment.

As shown in FIG. 3, if the accelerator pedal is depressed during acceleration and the idle switch of the throttle sensor 20 is turned "OFF" at the time $t_1$ as shown in FIG. 3(A), then, prior to increase in the throttle valye opening TA and the intake pressure PM, an after-idle correction (hereinafter referred to as "LL correction"), in which a very quick correction is obtained, is achieved. Thus, for example, this LL correction value is obtained such that a coefficient F of correction is made to be a predetermined positive valve, and subsequently, attenuated every rotation of the engine or every predetermined time interval at a predetermined attenuation rate $v_1$ to zero.

Subsequntly if the throttle valve 18 is further opened and the throttle valve opening TA detected from an output of the potentiometer of the throttle sensor 20 begins to rise from the time $t_2$ as shown in FIG. 3(B), then, prior to the increase in the intake pressure PM, the throttle valve opening correction (hereinafter referred to as "TA correction"), in which a quick correction is obtained in accordance with the increasing speed of the throttle valve opening TA, is achieved. More specifically, for example, this TA correction is obtained such that a value (positive value) obtained by integrating values each corresponding to a varying value with every predetermined time of the throttle valve opening TA is made to be a coefficient F of correction, which is then attenuated every rotation of the engine or every predetermined time interval to a predetermined level $L_1$ variable in accordance with the temperature of engine coolant at a predetermined high attenuation rate $v_2$, and after the predetermined level $L_1$ is reached, to zero at a predetermined low attenuation rate $v_3$.

Further, when the intake pressure PM begins to increase after the increase of the throttle valve opening TA, an intake pressure correction (hereinafter referred to as "PM correction"), in which a highly accurate correction is obtained in accordance with an increasing speed of the intake pressure PM, is performed from the time $t_3$ on as indicated by a solid line C in FIG. 3(D). More specifically, for example, this PM correction value is obtained such that a value (positive value) obtained by integrating values each corresponding to a varying value with every predetermined time of the intake pressure PM is made to be a coefficient F of correction, which is then attenuated every rotation of the engine or every predetermined time interval to a predetermined level $L_1$ variable in accordance with the temperature of engine coolant at a predetermined high attenuation rate $v_4$, and after the predetermined level $L_1$ is reached, to zero at a predetermined low attenuation rate $v_5$, ($v_4 < v_2$, $v_5 < v_1$, $v_3$).

In this case, during a time period between the times $t_2$ and $t_3$, the LL correction and the TA correction are overlapped with each other, during a time period between the times $t_3$ and $t_4$, all of the corrections are overlapped, and further, during a time period between the times $t_4$ and $t_5$, the TA correction and the PM correction are overlapped with each other. If all of the corrections are overlapped to obtain the correction value, particularly, there will be such a possibility that an excessive correction value be brought about due to the influences of the LL correction and the TA correction which are quick in response, but low in accuracy. In consequence, in this embodiment, the correction value for acceleration is obtained by plotting the maximal values of the LL correction, the TA correction and the PM correction as indicated by thick solid line in FIG. 3(D).

Next, during deceleration, when the throttle valve 18 begins to be closed from the time $t_6$, prior to a decrease in the intake pressure PM, the throttle valve opening correction (hereinafter referred to as "TA correction"), in which a quick correction is obtained in accordance with the decreasing speed of the throttle valve opening TA, is achieved as indicated by a solid line D in FIG. 3(D). More specifically, for example, this TA correction value is obtained such that a value (negative value) obtained by integrating values each corresponding to a varying value with every predetermined time of the throttle valve opening TA is made to be a coefficient F of correction, which is then restored every rotation of the engine or every predetermined time interval to a predetermined level $L_2$ variable in accordance with the temperature of engine coolant at a predetermined high restoration rate $v_6$, and after the predetermined level $L_2$ is reached, to zero at a predetermined low restoration rate $v_7$.

Subsequently, when the intake pressure PM begins to, an intake pressure correction (hereinafter referred to as "PM decrease correction"), in which a highly accurate correction is obtained in accordance with decreasing speed of the intake pressure PM, is achieved as indicated by a solid line E in FIG. 3(D). More specifically, for example, this PM correction value is obtained such that a value (negative value) obtained by integrating values each corresponding to a varying value with every predetermined time of the intake pressure PM is made to be a coefficient F of correction, which is then restored every rotation of the engine or every predetermined time interval to a predetermined level $L_2$ variable in accordance with the temperature of engine coolant at a predetermined high restoration rate $v_8$, and after the predetermined level $L_2$ is reached, to zero at a predetermined low restoration rate $v_9$, ($v_8 < v_6$, $v_9 < v_7$).

In this case, if both the TA correction and the PM correction are obtained together when both corrections are overlapped with each other, there will be a possibility that an excessive correction value be brought about. In consequence, in this embodiment, as indicated by thick solid line in FIG. 3(D), by plotting the minimal values of the TA correction and the PM correction, only the TA correction is obtained during a period between the times $t_7$ and $t_8$ and also only the PM correction is obtained during a period between the times $t_8$ and $t_9$.

Figure 4:
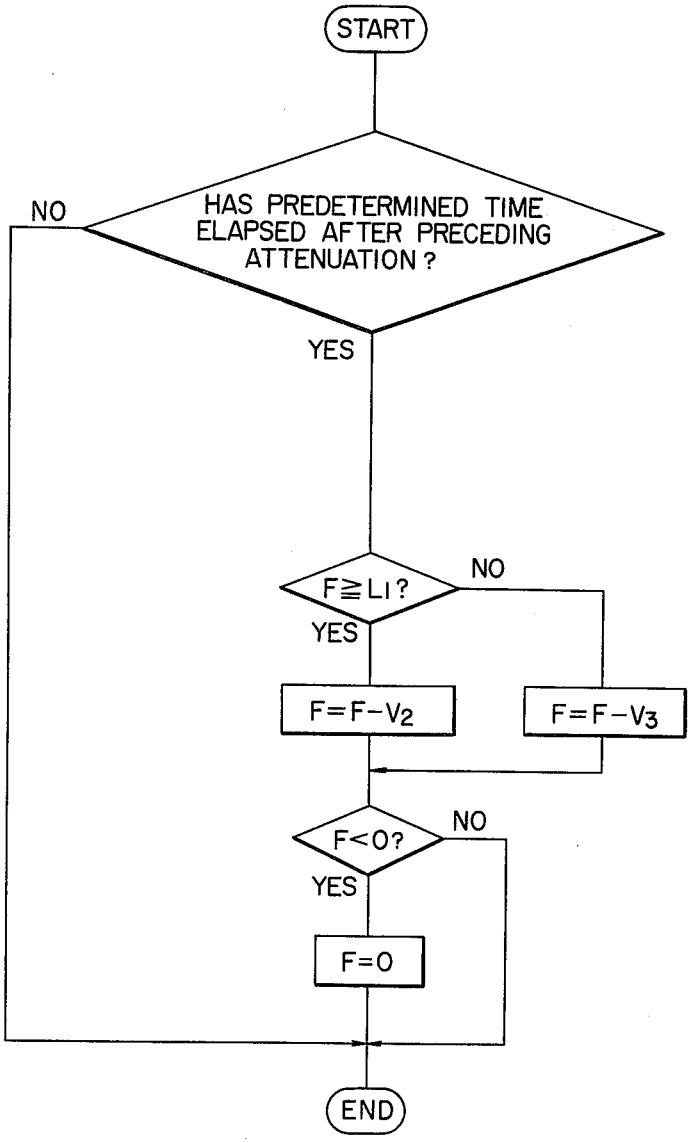
FIG. 4 is a flow chart showing the program of attenuation of the increase correction for acceleration in accordance with an increasing speed of the throttle valve opening.
Figure 5:
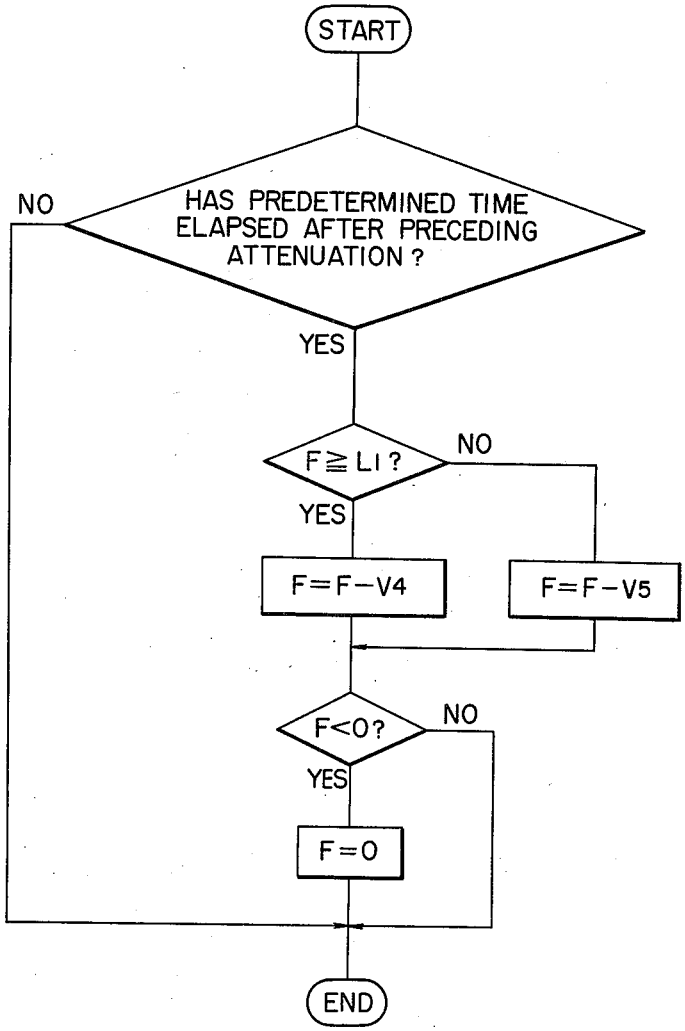
FIG. 5 is a flow chart showing the program of attenuation of the increase correction for acceleration in accordance with an increasing speed of the intake pressure.

In this embodiment, in obtaining the correction value for acceleration or deceleration, the attenuation rates $v_1$, $v_2$ and $v_3$ or the restoration rates $V_6$ and $V_7$ of the LL correction or the TA correction which is obtained prior to the PM correction are made higher than the attenuation rates $v_4$ and $v_5$ or the restoration rates $v_8$ and $v_9$ of the PM increase or decrease correction, so that the adverse influences of the LL correction or the TA correction, both of which are quick in response, but low in accuracy, can disappear in a short period of time, thereby enabling to effect an accurate air-fuel ratio correction based on the PM correction functioning more accurately, during transition. FIG. 4 shows the program of attenuation of the TA correction, and FIG. 5 shows the program of attenuation of the PM correction.

As has been described hereinabove, the LL correction being very quick in response, the TA correction being quick in response and the PM correction being high in accuracy are combined to achieve the increase correction for acceleration or the decrease correction for deceleration, whereby, when the accelerator pedal is quickly depressed, a correction value of a high level is obtained, and, when the accelerator pedal is slowly and gradually depressed, increase correction value of a low level is obtained, so that a suitable correction can be materialized depending on how the accelerator pedal is depressed, thereby enabling to maintain the air-fuel ratio in the vicinity of the stoichiometric air-fuel ratio to make the acceleration or deceleration performance compatible with the exhaust gas purification performance.

Additionally, in the above-described embodiment, during acceleration, the LL correction, the TA correction and the PM correction are combined to obtain the acceleration correction value, and, during deceleration, the TA correction and the PM correction are combined to obtain the deceleration correction value. However, the combination of the acceleration correction values or the deceleration correction values should not necessarily be limited to this, but, for example, the LL correction value can be omitted.

It should be apparent to those skilled in the art that the above-described embodiments are merely representative, which represent the applications of the principles of the present invention. Numerous and varied other arrangements can be readily devised by those skilled in the art without departing from the spirit and the scope of the invention.

What is claimed is:

1. Electronic fuel injecting method for an internal combusion engine comprising the steps of:

obtaining a basic injection time in accordance with an intake pressure of the engine and an engine rotational speed;

increasing a throttle valve opening correction in accordance with an increasing speed of the throttle valve opening, and subsequently attenuating the throttle valve opening correction gradually at a predetermined attenuation rate;

increasing an intake pressure correction in accordance with an increasing speed of the intake pressure, and subsequently attentuating the intake pressure correction gradually at a predetermined attentuation rate, the throttle valve opening correction predetermined attentuation rate being greater than the intake pressure correction attentuation rate;

combining the throttle valve opening correction and the intake pressure correction to obtain a correction value for acceleration and deceleration; and correcting the basic injection time in accordance with the correction value.

2. Electronic fuel injecting method for an internal combusion engine comprising the steps of:

obtaining a basic injection time in accordance with an intake pressure of the engine and an engine rotational speed;

increasing an after-idle correction when an idle switch is turned "OFF", and subsequently, attenuating the after-idle correction gradually at a predetermined attenuation rate;

increasing a throttle valve opening correction in accordance with an increasing speed of the throttle valve opening, and subsequently, attenuating the throttle valve opening correction gradually at a predetermined attenuation rate;

increasing an intake pressure correction in accordance with an increasing speed of the intake pressure, and subsequently, attenuating the intake pressure correction gradually at a predetermined attenuation rate, the attenuation rates of the after-idle correction and the throttle valve opening correction being greater that the attenuation rate of the intake pressure correction;

combining the after-idle correction, the throttle valve opening correction and the intake pressure correction to obtain a correction value for acceleration; and correcting the basic injection time in accordance with the correction value.

3. Electronic fuel injecting method for an internal combustion engine as set forth in claim 2, wherein said after-idle correction increasing step increases said after-idle correction by a predetermined positive value, and subsequently, said after-idle correction is attenuated every predetermined interval to zero.

4. Electronic fuel injecting method for an internal combustion engine as set forth in claim 1 or 2, wherein said throttle valve opening correction increasing step increases said throttle valve opening correction by a positive value obtained by integrating values each corresponding to a changing speed of the throttle valve opening, and subsequently, said throttle valve opening correction is attentuated every predetermined interval to a predetermined level variable in accordance with the temperature of engine coolant at a predetermined high attenuation rate, and after the predetermined level is reached, to zero at a predetermined low attenuation rate.

5. Electronic fuel injecting method for an internal combustion engine as set forth in claim 1 or 2, wherein said intake pressure correction increasing step increases said intake pressure correction by a positive value obtained by integrating values each corresponding to a changing speed of the intake pressure, and subsequently, said intake pressure correction is attenuated every predetermined interval to a predetermined level variable in accordance with the temperature of engine coolant at a predetermined high attenuation rate, and after the predetermined level is reached, to zero at a predetermiend low attenuation rate.

6. Electronic fuel injecting method for an internal combustion engine, comprising the steps of:

obtaining a basic injection time in accordance with an intake pressure of the engine and an engine rotational speed;

decreasing a throttle valve opening correction in accordance with a decreasing speed of the throttle valve opening, and subsequently restoring the throttle value opening correction gradually at a predetermined restoration rate;

decreasing an intake pressure correction in accordance with a decreasing speed of the intake pressure, and subsequently restoring the intake pressure correction gradually at a predetermined restoration rate, the throttle valve opening correction restoration rate being greater than the intake pressure correction restoration rate;

combining the throttle valve opening correction and the intake pressure correction to obtain a correction value for deceleration; and correcting the basis injection time in accordance with the correction value.

7. Electronic fuel injecting method for an internal combusion engine as set forth in claim 6, wherein said throttle valve opening correction decreasing step decreases said throttle valve opening correction by a negative value obtained by integrating values each corresponding to a changing speed of the throttle valve opening, and subsequently, said throttle valve opening correction is restored every predetermined interval to a predetermined level variable in accordance with the temperature of engine coolant at a predetermined high restoration rate, and after the predetermined level is reached, to zero at a predetermined low restoration rate.

8. Electronic fuel injecting method for an internal combustion engine as set forth in claim 6, wherein said intake pressure correction decreasing step decreases said intake pressure correction by a negative value obtained by integrating values each corresponding to a changing speed of the intake pressure, and subsequently, said intake pressure correction is restored every predetermined interval to a predetermined level variable in accordance with the temperature of engine coolant at a predetermined high restoration rate, and after the predetermined level is reached, to zero at a predetermined low restoration rate.

9. Electronic fuel injection device for an internal combustion engine, comprising:

an intake air temperature sensor for detecting the temperature of intake air taken in;

a throttle sensor including an idle switch for detecting whether a throttle valve is in an idle setting or not and a potentiometer for generating a voltage output proportional to the opening of the throttle valve;

an intake pressure sensor for detecting an intake pressure;

an injector or injectors for providing fuel to the engine;

a crank angle sensor of outputting a crank angle signal in accordance with a rotation of the engine;

a coolant temperature sensor for detecting the temperature of engine coolant; and digital control circuit means for obtaining a basic injection time in accordance with an intake pressure fed from the intake pressure sensor and an engine rotational speed obtained from an output from the crank angle sensor, correcting the basic injection time thus obtained in accordance with at least an output from the throttle sensor and the temperature of engine coolant fed from the coolant temperature sensor to determine a fuel injection time and outputting an injector opening time signal to the injector, increasing an after-idle correction when said idle switch is turned "OFF", and subsequently, attenuating said after-idle correction gradually at a predetermined attenuation rate, changing a throttle valve opening correction in accordance with a changing speed of the throttle valve opening obtained from an output of the potentiometer of the throttle sensor, and subsequently attenuating or restoring said throttle valve opening correction at a predetermined attenuation or restoration rate, changing an intake pressure correction in accordance with a changing speed of the intake pressure detected from an output of the intake pressure sensor, and subsequently, attenuating or restoring said intake pressure correction at a predetermined attenuation or restoration rate, combining the after-idle correction, the throttle valve opening correction and the intake pressure correction to obtain a correction value for acceleration and deceleration, the attenuation rates or the restoration rate of the after-idle correction and the throttle valve opening correction being greater than the attenuation rate or the restoration rate of the intake pressure correction, and correcting the injector opening time signal in accordance with the correction value.

* * * * *